United States Patent [19]

Fette et al.

[11] 4,441,200

[45] Apr. 3, 1984

[54] DIGITAL VOICE PROCESSING SYSTEM

[75] Inventors: Bruce Fette, Mesa; Rose M. Gibson, Phoenix; Donald P. McCabe, Mesa, all of Ariz.

[73] Assignee: Motorola Inc., Schaumburg, Ill.

[21] Appl. No.: 309,640

[22] Filed: Oct. 8, 1981

[51] Int. Cl.[3] ..... G10L 1/00

[52] U.S. Cl. ..... 381/36; 364/513.5

[58] Field of Search ..... 179/1 HF, 15.55 R, 15.55 T, 179/1 SA; 381/28–53; 375/58, 122

[56] References Cited

U.S. PATENT DOCUMENTS

| | | | |
|---|---|---|---|
| 4,004,096 | 1/1977 | Bauer et al. | 179/1 SC |
| 4,216,354 | 8/1980 | Esteban et al. | 179/15.55 R |
| 4,330,689 | 5/1982 | Kang et al. | 179/15.55 R |
| 4,356,509 | 10/1982 | Skerlos et al. | 179/1 HF |

*Primary Examiner*—E. S. Matt Kemeny

*Attorney, Agent, or Firm*—Eugene A. Parsons

[57] ABSTRACT

A multiple rate voice processing system incorporating a complete linear predictive coding algorithm wherein the algorithm is partitioned among a plurality of integrated circuit chips so that all communications between chips occur at low data rates.

10 Claims, 8 Drawing Figures

FIG 1
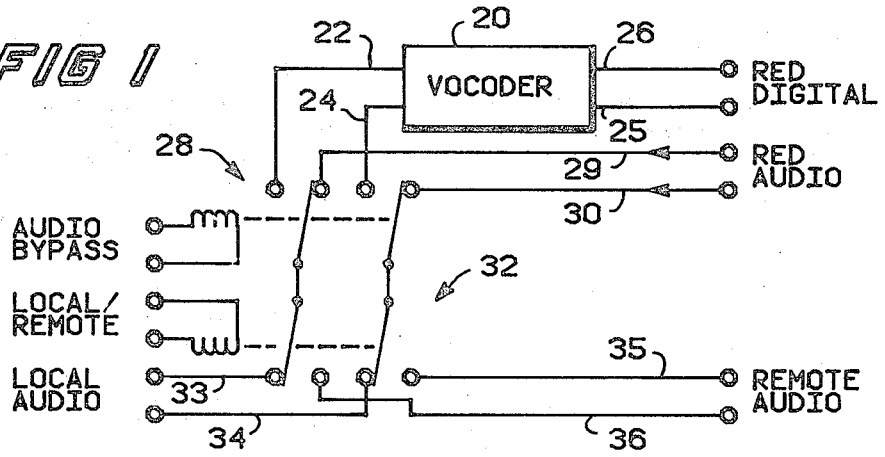
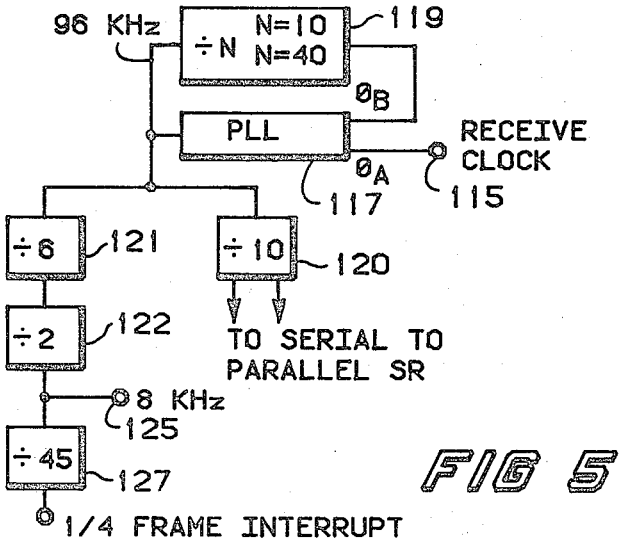
FIG 5

DIGITAL VOICE PROCESSING SYSTEM

BACKGROUND OF THE INVENTION

In the communications field it is often advantageous to transmit signals representative of the human voice without transmitting the entire voice signal. Several vocoder algorithm are available for analyzing the human voice so that a representative signal greatly reduced in bandwidth and information can be transmitted. When the signal is received the human voice is synthesized, or reproduced, from the received signal.

In general, the vocoder algorithms require a tremendous amount of circuitry or the bit rate of communications between circuits is extremely high so that a relatively large amount of power is required.

SUMMARY OF THE INVENTION

The present invention pertains to a digital voice processing system and method of manufacturing the system incorporating a complete vocoder algorithm, which system includes a first integrated circuit semiconductor chip having circuits thereon for providing pitch extraction, a second integrated circuit semiconductor chip having circuits thereon for analyzing a human voice, a third integrated circuit semiconductor chip having circuits thereon for synthesizing the human voice, a fourth integrated circuit semiconductor chip having a microprocessor thereon and circuits interconnecting the four integrated circuits to provide duplex operation, the vocoder algorithm being partitioned among the integrated circuits so that all communications therebetween occur at low data rates.

It is an object of the present invention to provide a digital voice processing system incorporating a complete vocoder algorithm wherein the algorithm is partitioned among a plurality of integrated circuit semiconductor chips so that all communications between the chips occurs at low data rates.

It is a further object of the present invention to provide a digital voice processing system incorporating a complete vocoder algorithm wherein the amount of circuitry utilized is greatly reduced and the amount of power required is greatly reduced.

These and other objects of this invention will become apparent to those skilled in the art upon consideration of the accompanying specification, claims and drawings.

BRIEF DESCRIPTION OF THE DRAWINGS

Referring to the drawings wherein like characters indicate like parts throughout the figures:

FIG. 1 is a schematic view of the external connections for a digital voice processing system;

FIG. 5 is a block diagram of a timing portion of the system of FIG. 2 for the receive function;

DESCRIPTION OF THE PREFERRED EMBODIMENT

Figure 2:
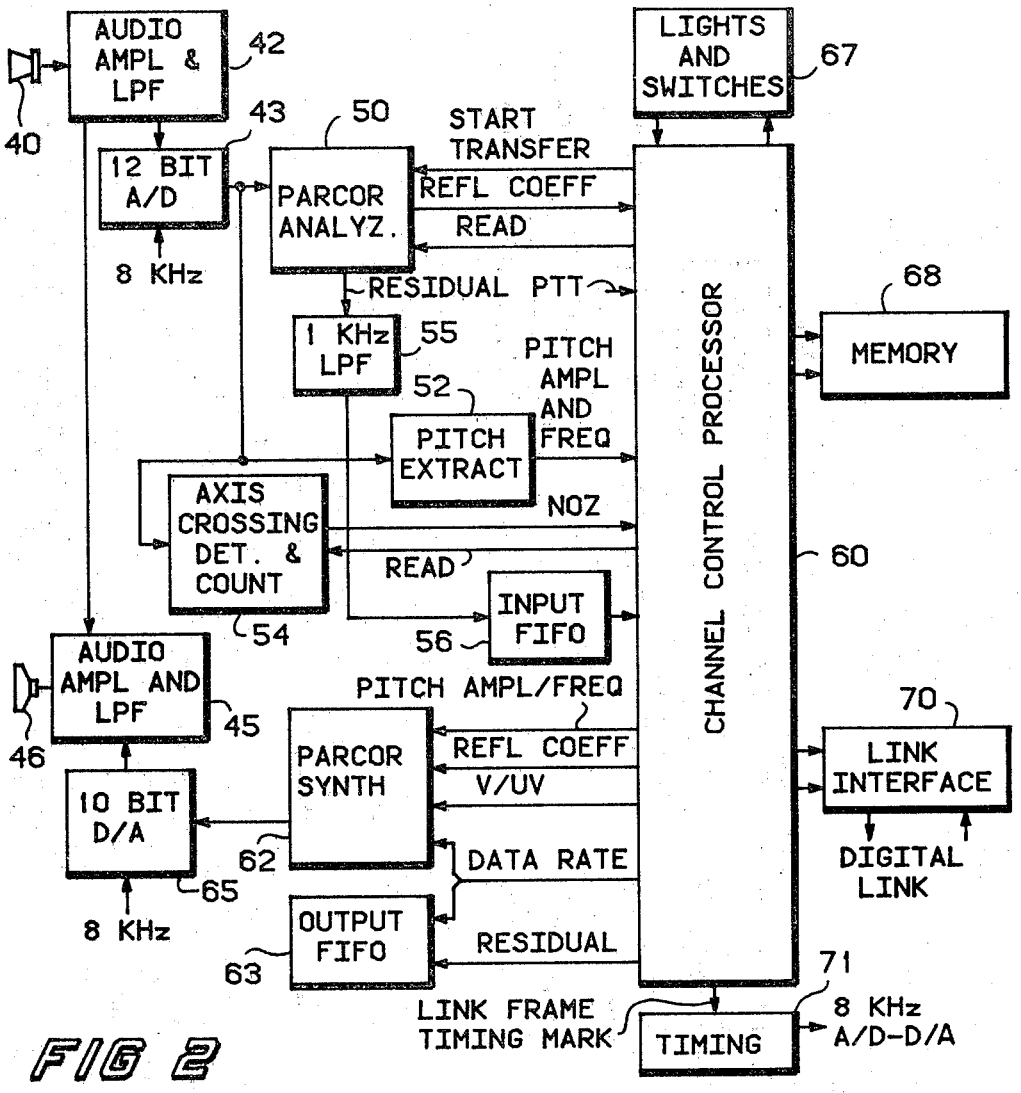
FIG. 2 is a block diagram of a digital voice processing system embodying the present invention.

FIG. 1 illustrates a typical connection for a vocoder, or voice processing system, 20. The vocoder 20 has an audio input 22, an audio output 24, a digital input 25 and a digital output 26. The digital input 25 and output 26 may be connected to some transmission device or media for remote transmission. The audio input 22 is connected to a stationary contact of a double pole double throw switch 28. The audio output 24 of the vocoder 20 is connected to a second stationary contact of the switch 28 and a pair of leads 29 and 30, adapted to supply audio directly from a transmission device, are connected to two other stationary contacts of the switch 28 so that the pair of moveable contacts will supply audio to and receive audio from the vocoder 20 or the pair of lines 29 and 30. The transmitted audio on the lines 29 and 30 may be special audio signals, other than voice, or may be used for any of a number of purposes which will be apparent to those skilled in the art.

The two moveable contacts of the switch 28 are connected directly to two moveable contacts of a double pole double throw switch 32, the stationary contacts of which are connected to a pair of lines 33 and 34 adapted to receive local audio and a pair of lines 35 and 36 adapted to receive remote audio. The lines 33 and 34 may be connected to, for example, a local microphone and speaker and the pair of lines 35 and 36 may be connected to, for example, a remote microphone and speaker. It will of course be understood by those skilled in the art that many other types of voice, and/or audio, reproducing devices, can be utilized and the present connections are described only by way of example.

Referring specifically to FIG. 2, a block diagram of the vocoder 20 is illustrated. An audio input, which in this embodiment is a microphone 40, is connected to an audio amplifier and low pass filter 42. The amplifier and low pass filter 42 supplies an output to a 12 bit analog-to-digital converter 43 and to a second audio amplifier and low pass filter 45. The audio amplifier and low pass filter 45 has an audio output, which in this embodiment is a speaker 46, connected thereto. The output of the analog-to-digital converter 43 is supplied to a partial correlation analyzer 50, a pitch extractor 52 and an axis crossing detector and counter 54. The partial correlation analyzer 50 has an output which is connected through a 1 KHz low pass filter 55 to an input first in first out (FIFO) register 56. The partial correlation analyzer 50, the pitch extractor 52, the axis crossing detector and counter 54, and the input register 56 are all connected to a channel control processor, or microprocessor, 60. A partial correlation synthesizer 62 having an output first in first out register 63 associated therewith is also connected to the microprocessor 60. The output of the synthesizer 62 is supplied to a 12 bit digital-to-analog converter 65, the output of which is supplied through the audio amplifier and low pass filter 45 to the audio output speaker 46. Various lights and switches and control signals 67 are operatively connected to the processor 60 for indicating and controlling the operation thereof. A memory 68, which includes a 4K by 16 bit read-only memory (ROM) and a 2K by 16 bit random access memory (RAM), is operatively connected to the processor 60 and may, if practical, be formed on the same integrated circuit semiconductor chip therewith. A link interface 70 connects the microprocessor 60 with a digital link for transmission and reception of digital signals. The digital link may be, for example, telephone lines, a radio link, etc. A timing block 71 is connected to receive signals from the processor 60 and provide 8 KHz timing signals to the analog-to-digital converter 43 and the digital-to-analog converter 65.

The partial correlation analyzer 50 may be, for example, an integrated circuit semiconductor chip similar to that described in co-pending U.S. patent application entitled "HUMAN VOICE ANALYZING APPARATUS", U.S. Pat. Ser. No. 267,204, filed May 26, 1981, and assigned to the same assignee. The partial correlation analyzer 50 produces 10 reflection coefficients and an RMS value per frame from the digital data provided by the converter 43. In the present embodiment the frame is 22.5 msec. long. It will of course be understood by those skilled in the art that the numbers and frequencies utilized herein, e.g., 10 reflection coefficients, 22.5 msec/frame, etc., can be varied to suit the specific application of the system. The system described herein is for use over telephone lines, but the operating frequencies and times of the system could be changed substantially for use in a radio link or the like. The 10 reflection coefficients and the RMS value are made available to the processor 60 on demand by way of an internal 12 bit wide first in first out (FIFO) register in the analyzer 50. The analyzer 50 will recognize a request by the processor 60 on a start transfer line to begin transfer of reflection coefficients and will reset an internal first in first out pointer. Thirteen successive reads by the processor 60 will empty the first in first out register of the analyzer 50.

The present embodiment of the digital voice processing system is a multiple rate processor which operates in either a 2400 bit per second or 9600 bit per second mode. These specific modes are peculiar to specific telephone line links and it will be understood that other bit rates might be utilized for different applications. In the 2400 bits per second mode of operation the residual signal from the partial correlation analyzer 50 is discarded and an internal excitation is generated, as will be described presently. In the 9600 bits per second mode of operation a residual output is supplied by the partial correlation analyzer 50 through the 1 KHz low pass filter 55 to the register 56. The residual register 56 supplies the low pass filtered, down sampled residual, to the microprocessor 60 2000 times per second.

The pitch extractor 52 is, for example, an absolute magnitude difference function (AMDF) generator similar to that described in co-pending U.S. patent application entitled "ABSOLUTE MAGNITUDE DIFFERENCE FUNCTION GENERATOR FOR AN LPC SYSTEM", U.S. Pat. Ser. No. 205,537, filed Nov. 20, 1980, and assigned to the same assignee. Other types of pitch extractors, such as a Gold-Rabiner may be utilized if desired. However, an AMDF extractor will be described herein because of its simplicity. The pitch extractor 52 calculates wave form similarity versus delay, for 60 values of delay, and determines the minimum value for that frame. The 60 values of AMDF, the AMDF minimum value, index of the minimum, and the low pass energy will be transferred to the processor 60 (63 values on 26 data lines) every frame, or 22.5 msec.

Twice per frame a voice/unvoice decision is made by the processor 60, as will be explained in more detail presently. At half frame boundaries, the pitch extractor 52 is initialized to provide a low pass speech energy (ISTU) signal and the number of zero crossings (NOZ) is read from the axis crossing detector and counter 54. This information is used in the microprocessor 60 to provide a tentative voice/unvoice decision.

The partial correlation synthesizer 62 may be, for example, apparatus similar to that described in copending U.S. patent application entitled "SPEECH SYNTHESIZER", U.S. Pat. Ser. No. 267,203, filed May 26, 1981, and assigned to the same assignee. The synthesizer 62 receives from the microprocessor 60 reflection coefficients, pitch amplitude/frequency signals and a voice-/unvoiced signal per frame. In the 9600 bits per second mode of operation the register 63 also supplies residual excitation to the synthesizer 62. The synthesizer 62 utilizes the supplied signals to reconstruct a digital signal which, upon being converted to an analog signal by the converter 65, is substantially similar to the original voice signal. In fact, the timing associated with the microprocessor 60 is such that the microprocessor 60 may provide 4 sets of reflection coefficient amplitude parameters per frame to the synthesizer 62. While all 4 sets of parameters could be utilized, the synthesizer 62 is usually controlled to use only one set of parameters per frame.

In the present embodiment the microprocessor 60 is an MC68000 microprocessor with a 7 level interrupt control. Processor interrupts, in the 68000 architecture, are accomplished on a priority level basis. Inputs to the 68000 from the interrupt control sends a prioritized interrupt request from the interrupt control. This priority level, 0 through 7, is compared in the 68000's current processor running status. If the priority of the device requesting service is higher than the current running priority, the 68000 acknowledges the interrupt, and processing is vectored to the device service routine. Three devices in the present system will interrupt the microprocessor 60: the link interface 70 ( priority 7, highest), register 63 half empty (priority 6), register 56 half full (priority 5), and frame clock (priority 4). The link interface 70 includes an 8 bit by 32 word parallel to serial transmit first in first out register, an 8 bit by 32 word serial to parallel receive first in first out register and timing so that duplex operation, either full or half, is provided.

Figure 3:
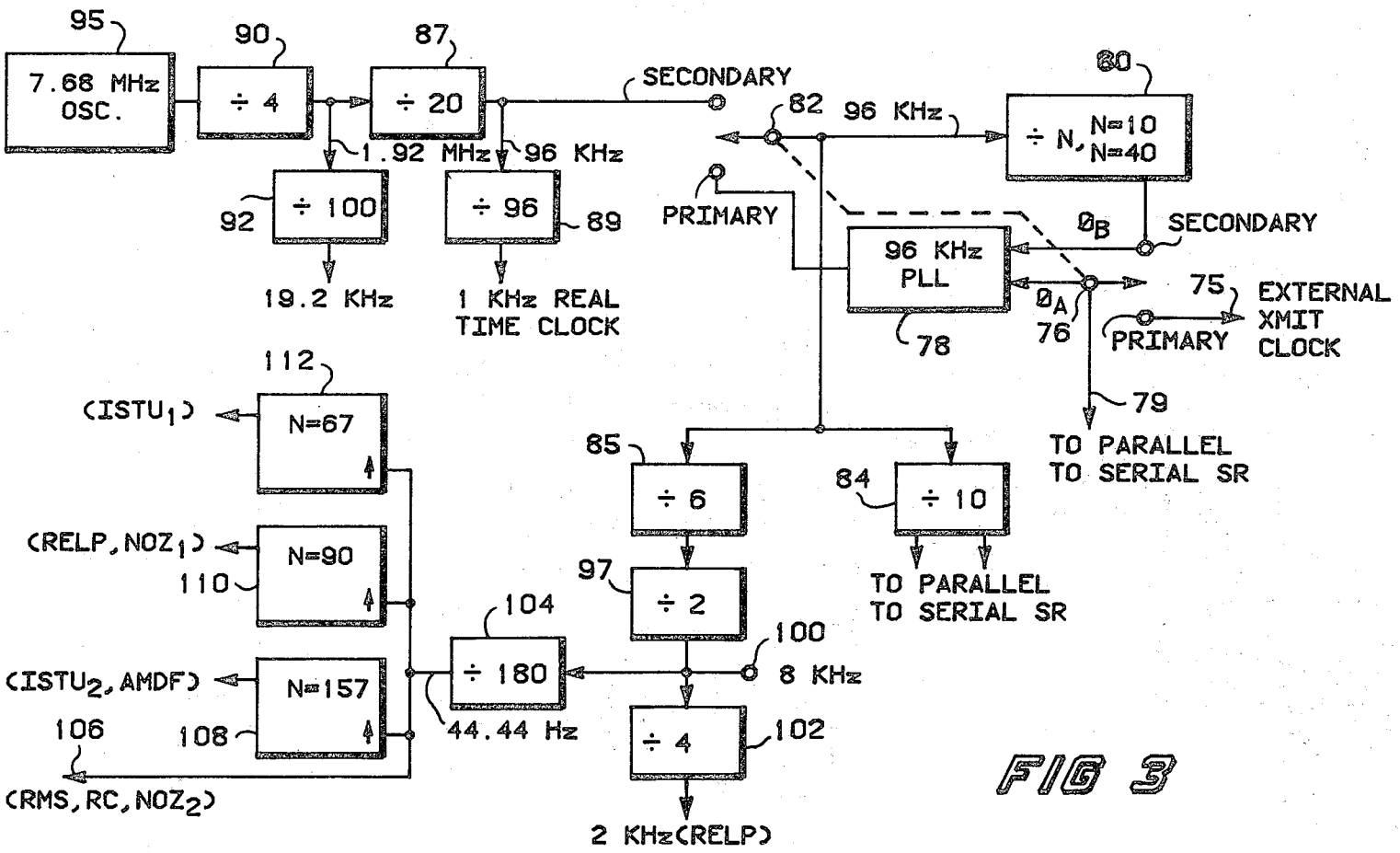
FIG. 3 is a block diagram of a timing portion of the system illustrated in FIG. 2 for the transmit function.

Referring specifically to FIG. 3, a timing block diagram is illustrated for the system during the transmit mode of operation. An external transmit clock (not shown) supplies clock pulses to an input terminal 75, which clock pulses are provided at a predetermined repetition rate. This repetition rate, or frequency, may be fixed or, as in the present embodiment featuring a multiple rate processor, may include a variety of selectable operating frequencies. In the present embodiment the frequency of the external transmit clock is 2.4 KHz or 9.6 KHz. The input terminal 75 is connected to a stationary contact, designated primary, of a single pole double throw switch 76. The moveable contact of the switch 76 is connected to a first input, designated $\phi_A$, of a phase locked loop 78 and to an input terminal 79 for the parallel to serial converter in the link interface 70 (see FIG. 2). A second input of the phase locked loop 78, designated $\phi_B$, is connected to the output of a divider circuit 80. The output of the divider circuit 80 is also connected to a second stationary contact of the switch 76, designated secondary. The output of the phase locked loop 78 is connected to a stationary contact, designated primary, of a second single pole double throw switch 82. The switches 76 and 82 are mechanically linked together for simultaneous operation and, could be a double pole double throw switch. The moveable contact of the switch 82 is connected to the input of the divider 80 and to the inputs of a pair of dividers 84 and 85. Divider 80 is a variable divider which is controllable to divide by the factors 10 or 40, in this enbodiment. The phase locked loop 78 is constructed to operate at 96 KHz and, when the input clock at the terminal 75 is 9.6 KHz the divider 80 is controlled to divide by 10. When the input clock at the terminal 75 is 2.4 KHz the divider 80 is controlled to divide by 40.

A second fixed contact of the switch 82, designated secondary, is connected to the output of a fixed divider 87. The output of the fixed divider 87 is also connected to the input of a fixed divider 89. The input of the fixed divider 87 is connected to the output of a fixed divider 90, which output is also connected to the input of a fixed divider 92. A 7.68 MHz oscillator 95 is connected to the input of the fixed divider 90. The dividers 87, 89, 90 and 92 are designed to divide by factors of 20, 96, 4 and 100, respectively. The secondary fixed contacts of the switches 76 and 82 provide a test circuit which supplies 96 kHz from the divider 87 to the phase locked loop 78 for test purposes. The divider 92 provides a 19.2 kHz clock signal at the output thereof which is utilized as a timing signal for a debugging printer (not shown) which in this embodiment is a TI Silent 700. The divider 89 provides a 1 kHz real time clock which is utilized in the microprocessor 60 to switch operating modes between receive and transmit. The 1 kHz real time clock changes the mode of operation of the microprocessor 60 every millisecond to allow a smooth overlap between the transmit and receive operations. The transmit and receive operations are controlled by different clock frequencies and there is a tendency for one to slide past the other in time so that errors in operation occur if simultaneous operation is not accommodated.

The divider 84 is a fixed divider which divides the 96 kHz from the phase locked loop by 10. The divider 84 has a pair of parallel outputs which are connected to the parallel to serial converter in the link interface 70 for down sampling 9.6 Kbs of data to 2.4 Kbs data when the system is operating in the 2.4 kHz mode. The information inside the microprocessor 60 is always provided at 9.6 Kbs in the present embodiment and the divider 84 provides the timing which causes the parallel to serial converter to sample every fourth bit, rather than every bit from the microprocessor 60, to provide the 2.4 Kbs data output.

The divider 85 is a fixed divider which divides by a factor of 6 and supplies a 16 kHz signal to a second fixed divider 97. Divider 97 divides by a factor of 2 to provide an 8 kHz signal at a terminal 100, at the input of a fixed divider 102, and at the input of a fixed divider 104. The 8 kHz timing signal at the terminal 100 is supplied to the analog to digital converter 43 so that 8000 digital samples per second are supplied by the converter 43 to the system. Because the 8 kHz timing signal at the terminal 100 and the external transmit clock at the terminal 75 must be in an exact ratio, the phase locked loop 78 is utilized in the timing circuitry to maintain a constant output. The fixed timer 102 is a divide by 4 circuit which provides a 2 kHz timing signal. The 2 kHz timing signal is supplied to the analyzer 50 (FIG. 2) and clocks the residual signal out of the analyzer and to the low pass filter 55.

The divider 104 is a fixed divider which divides the 8 kHz signal by a factor of 180 to provide a 44.44 Hz signal at the output thereof. The 44.44 Hz signal is applied directly to an output terminal 106, a circuit 108, a circuit 110, and a circuit 112. The output of the circuit 112 supplies 8.735 msec timing pulses to the pitch extractor 52 (FIG. 2) to instruct the pitch extractor 52 to read a signal designated $ISTU_1$ into the microprocessor 60. The signal $ISTU_1$ represents the average energy in that portion of the speech waveform after being low pass filtered. A more complete description of the signal is available in the above described co-pending application entitled "ABSOLUTE MAGNITUDE DIFFERENCE FUNCTION GENERATOR FOR AN LPC SYSTEM". Circuit 110 provides 11.25 msec timing pulses at the output thereof which are applied to the axis crossing detector and counter 54 (see FIG. 2) to read a signal, $NOZ_1$, into the microprocessor 60. Circuit 108 provides 19.625 msec timing pulses at the output thereof, which are applied to the pitch extractor 52 to read a signal designated $ISTU_2$ into the microprocessor 60. The 19.625 msec timing pulses are also applied to the pitch extractor 52 to read all of the remaining information from the pitch extractor 52 into the microprocessor 60 each frame. This information consists of 60 words representing 60 AMDF values, a word representing the value of the minimum of the 60 AMDF signals and a word representing an index for the minimum value. The terminal 106 provides 22.5 msec timing pulses to the analyzer 50 for reading the information from the analyzer 50 into the microprocessor 60. Specifically, this informtion includes 10 correlation, or reflection, coefficients and an RMS value for the current frame. The 22.5 msec timing pulses are also applied to the axis crossing detector and counter 54 to cause that circuit to read a second signal, $NOZ_2$, into the microprocessor 60. The microprocessor 60 then operates on all of the information supplied each frame and transmits a plurality of signals representing different voice characteristics to a remote system by way of the link interface 70.

Figure 4:
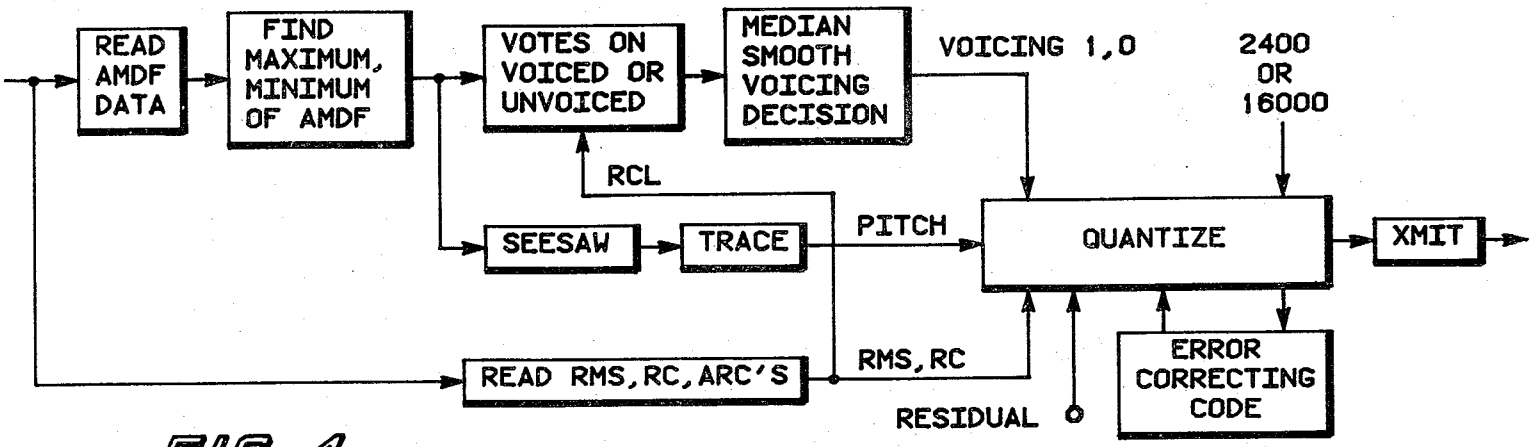
FIG. 4 is a simplified flowchart for the operations of the microprocessor illustrated in FIG. 2 during the transmit function.

Referring specifically to FIG. 4, the various functions of the microprocessor 60 are depicted by the functional blocks. Twice a frame, a voiced/unvoiced decision is made by the microprocessor 60. At half frame boundaries, the output FIFO of the pitch extractor 52 is initialized and the first parameter on the register is the low pass speech energy signal, $ISTU_1$. Also $NOZ_1$ is read from the axis crossing detector and counter 54. The maximum, minimum of the AMDF or pitch extractor 52, signals is determined and an initial voiced/unvoiced decision is made. Once a frame, the output FIFO of the analyzer 50 is initialized and 10 reflection coefficients and the RMS energy are read into the RAM of the microprocessor 60 for processing. A second voiced/unvoiced decision is made in the microprocessor 60 based on the newly received $ISTU_2$, $NOZ_2$, and the first reflection coefficient. The final voiced/unvoiced decision is encoded, or quantized, for transmission during this frame. The bandwidth of the LPC digital voice system is set by the number of bits used to describe each measured parameter and the frequency with which this snapshot picture of the articulators is updated. Thus, quantization strategies must be chosen to accommodate the entire range of naturally occurring values of the parameters but with fine enough quantization that perceptually significant errors are not made.

Excitation includes a voiced/unvoiced decision and, if voiced, the frequency of the excitation. This is typically coded on a logarithm of pitch frequency basis using about 6 bits, since the human perception of pitch frequency is approximately logarithmic. Use of fewer than 6 bits results in perceptually creaky or quavering voice. The value zero is usually assigned to unvoiced or noisy excitation, and values 1 through 63 are assigned to the natural human pitch range of 50 Hz to 400 Hz.

Amplitude is perceived logarithmically and is thus quantized logarithmically, typically with 5 bits.

Reflection coefficients have the nice property of being bounded between the natural limits of +1 and −1. Additionally, the first few reflection coefficients have the most predominant effect on the spectrum and thus can be quantized more finely than higher numbered reflection coefficients. For example the first reflection coefficent is quantized with 6 bits while the last reflection coefficient may be quantized with only 3 bits. The number of reflection coefficients required for reasonable fidelity is set by the desired audio bandwidth or accuracy of reconstructing the original spectrum. A successful guideline has been: two poles for every one kHz of bandwidth to accommodate performance plus 2 to 4 poles for general spectral shaping.

While LPC analysis is computationally quite lengthy it is mathmatically straightforward. In contrast, measurement of the excitation of the speech wave is still an area of art and research because there is no single clearly superior technique. Excitation analysis must decide if the vocal cords were used (voiced) as the energy source for the vocal tract, and if so, what was the frequency of vibration. The algorithm called absolute magnitude difference function (AMDF) and a voiced/unvoiced decision technique is utilized herein as representative of the correlation techniques for excitation analysis. In this technique the speech is first low pass filtered with a cutoff frequency accommodating three harmonics of the highest natural pitch frequency. This low pass filtering is accomplished in the pitch extractor 52. The low pass wave form is then analyzed, in the pitch extractor 52, for coherent energy by the average magnitude difference function. A running average of the minimum value of the AMDF array is stored in the microprocessor 60 over 8 voiced frames, to be used as a slope for picking local minima of the AMDF array. Thus, the more pronounced the minimum, the shallower the slope will be used to threshold other minimums in the AMDF array. This slope is reset to high numbers during unvoiced frames.

The index of local minimums of several frames are recorded by the microprocessor 60 so that the estimated pitch frequency may be traced backward through three frames watching for consistent, reliable estimates of the pitch frequency. A minimum value in the slope array is used as a starting point from which the microprocessor 60 traces back through two previous frames to the lag of the local minimum two frames ago which is consistently connected to the present lag.

This search for consistency by the microprocessor 60 has the capacity to correct occasional pitch halving and doubling errors in the indicated minimum, and to ignore incoherent low frequency noise, or fast moving format resonances. The microprocessor 60 will consistently choose the loudest coherent low frequency (less than 500 Hz) present longer than 67 msec.

The voiced/unvoiced decision is based on the energy in the low pass signal (ISTU) and on three previous voiced/unvoiced decisions and on AMDF max to min and a zero crossing rate, and reflection coefficients. The program in the microprocessor 60 first makes a tentative voiced/unvoiced decision and then makes a final decision by creating an adaptive threshold which is the average signal level over the past 8 unvoiced frames and comparing the adaptive threshold with present energy and the energy of the past frame. The voiced/unvoiced binary decision and the pitch frequency delayed 3 frames are the data which are passed from the pitch and voicing routines to the quantizer.

The residual signal is available in the (FIFO) 56 and is quantized once per frame by the microprocessor 60 and transmitted when the system is operating in the 9.6 kHz mode.

The microprocessor 60 also incorporates an error correcting code in conjunction with the quantizer. The specific code utilized in the present embodiment is the Hamming 8,4 error correcting code. This error correcting code is programmed into the microprocessor 60 which utilizes some of the transmitted bits to insure that other bits are correct, in a manner well known to those skilled in the art.

In addition to the quantized information already disclosed, synchronization bits are added by the microprocessor 60. Before data received by the processing system can be used in synthesis processing, it is necessary to determine frame boundaries by recognition of synchronization bits. In the 2.4 Kbps mode of operation the frame format consists of 53 information bits followed by a frame sync bit per 22.5 msec processing frame. The frame sync bit consists of an alternating one zero pattern for consecutive data frames. In the 9.6 kilo bit mode of operation the frame format consists of 216 bits per 22.5 msec frame subdivided into 4 subframes of 54 bits each. The first of the 4 subframes is identical in format to the 2.4 Kbps frame format. The following three subframes contain residual information consisting of 45 quantized residual words of 3 bits each, and 2 residual gain words, specifying the residual gain for the first and second half of the frame, with 6 bits of information for each residual gain word. The four most significant bits of the residual gain words are encoded by the error correcting code. Each subframe contains a sync bit as the last bit of the subframe.

Referring specifically to FIG. 5, a timing block diagram is illustrated for the received portion of the processing system. An input terminal 115 is adapted to have applied thereto receive clock signals of 2.4 kHz or 9.6 kHz frequency. The input terminal 115 is connected to an input, designated $\phi_A$, of a phase locked loop 117. The phase locked loop 117 is designed to always supply a 96 kHz signal at the output thereof, which is connected to a divider 119. The divider 119 is constructed to divide the output signal from the phase locked loop 117 by 10 in the 9.6 kHz mode of operation and by 40 in the 2.4 kHz mode of operation. The output of the divider 119 is supplied to a second input, designated $\phi_B$, of the phase locked loop 117. The output of the phase locked loop 117 is also supplied to a fixed divider 120, which divides the 96 kHz signal by 10 and has a pair of parallel outputs which are connected to the serial to parallel shift register in the link interface 70 (FIG. 2). The parallel outputs of the divider 120 cause the shift registers, and the synthesizer 62, to operate at 2.4 Kbps and discard 3 out of 4 samples supplied thereto. The down sampling of the divider 120 can cause the synthesizer 62 to discard three out of 4 samples (accept only the first 54 bit subframe) even if it is operating at 9.6 Kbps.

The 96 kHz signal from the phase locked loop 117 is also applied through a fixed divider 121 and a fixed divider 122. The fixed divider 121 divides the signal by 6 and the fixed divider 122 divides the output signal from the divider 121 by 2 to provide an 8 kHz signal at an output terminal 125. As previously described in conjunction with the transmitter timing block diagram, the received clock 115 and the 8 kHz signal at the terminal 125 must be an exact ratio and, therefore, the phase locked loop 117 is utilized. The 8 kHz signal at the terminal 125 is applied as a clock to the digital to analog converter 65. The 8 kHz signal from the divider 122 is also supplied to a fixed divider 127 which divides the signal by 45 to provide a one-quarter frame interrupt signal which is supplied to the interrupt control circuitry of the microprocessor 60. The quarter frame interrupt is the lowest priorioty interrupt of the 7 level control circuit.

While specific dividers are illustrated in the transmit and receive timing block diagrams, FIGS. 3 and 5 respectively, it will be understood by those skilled in the art that the specific blocks illustrated form a portion of the microprocessor 60 and the timing block 71 and may not actually appear as illustrated in the semifunctional timing block diagrams. For example, in each of the timing block diagrams the 96 kHz signal is divided down to an 8 kHz signal in 2 division steps. It will be obvious to those skilled in the art that these two steps might be combined into a single step or whatever number of steps are convenient for the specific apparatus being utilized.

Figure 6:
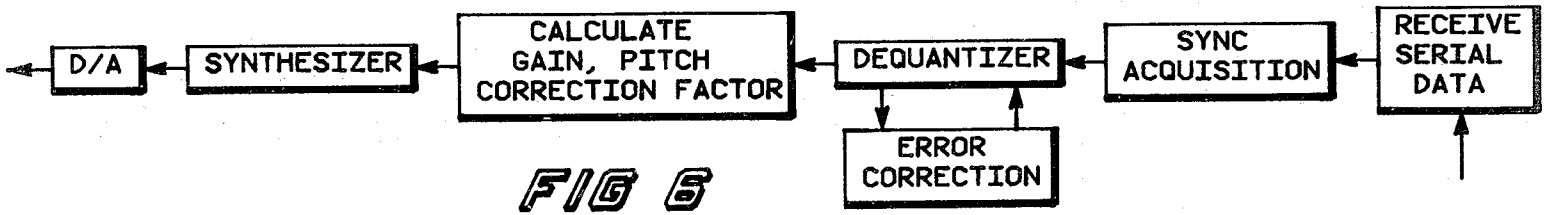
Figure 6 is a simplified flowchart illustrating the operations of the apparatus of FIG. 2 during the receive function.

Referring specifically to FIG. 6, the functions of the microprocessor 60, in the receive operation, are illustrated. Serial data is received at the link interface 70 and converted to parallel data which is applied to the microprocessor 60. Before received data can be used in the synthesizer 62 it is necessary to determine frame boundaries by recognition of synchronization bits. It is the responsibility of the frame synchronization portion of the microprocessor 60 to find the sync bits, lock on, and track for sync maintenance. In order for the microprocessor 60 to find the sync bits, a number of pointers and modular counters are incorporated, which are capable of detecting the sync bits within approximately 8 sync bits.

Once the sync bits are acquired and the frame boundaries are determined the data can be dequantized and error corrected. From the dequantized and error corrected data the microprocessor 60 calculates the gain and pitch correction factors before supplying all of the data, including reflection coefficients, voiced/unvoiced decision, pitch amplitude/frequency, gain and pitch correction factors, to the synthesizer 62. The synthesizer 62 then reconstructs the digital representation of the original voice signal as described in the above referenced copending application entitled "SPEECH SYNTHESIZER". The digital representation is then applied to the digital to analog converter 65 which converts the digital representation to an analog voiced signal.

The present voice processing system includes a complete linear predictive coding (LPC) vocoder algorithm in the 2.4 kHz or 9.6 kHz mode of operation and a residual linear predictive coding (RELPC) vocoder algorithm in the 9.6 kHz mode of operation. Further, duplex operation has been described and it will be understood by those skilled in the art that either full duplex or half duplex operation can be incorporated. By simply changing the software in the ROM of the microprocessor 60 the vocoder algorithm can be changed to linear predictive coding, adaptive predictive coding, or residual linear predictive coding. Other modifications to the vocoder algorithm might be provided by those skilled in the art and the specific steps or operations are intended only as an embodiment of one possible system.

In the voice processing system disclosed herein the data rate within the analyzer 50 is approximately 87 megabits per second. The data rate within the pitch extractor 52 is approximately 52.8 megabits per second. The data rate within the synthesizer 62 is approximately 44.8 megabits per second. The data rate within the microprocessor 60 is approximately 128 megabits per second. The specific vocoder algorithm utilized is partitioned among analyzer 50, pitch extractor 52, synthesizer 62, and microprocessor 60 so that all communications between these units is at a relatively low data rate. As an example, in this embodiment the data rate from analyzer 50 is approximately 6864 bits per second. The data rate from the pitch extractor is approximately 31680 bits per second. The data rate from analog to digital converter 43 to analyzer 50 and pitch extractor 52 is approximately 96000 bits per second. The data supplied to the parallel to serial transmit FIFO n link interface 70 is supplied at the rate of 54 bits per frame, 44.4 frames per second, or 2400 bits per second. The serial to parallel receive FIFO in link interface 70 supplies data to the microprocessor 60 at the rate of 2400 bits per second. The microprocessor supplies data to the synthesizer interface at a rate of 13 values, 12 bits per value, 44 times per second, or 6864 bits per second. Synthesizer 62 supplies data to digital to analog converter 65 at the rate of 8000 samples per second, 12 bits per sample, of 96000 bits per second. Thus, it can be seen that information is communicated between the components of the voice processing system at a data rate which is relatively low compared to the data rate internal to the components. By partitioning the vocoder algorithm among the various chips so that communication between the chips is at a relatively low data rate, the power consumption of the system is greatly reduced and the entire system can be constructed in a small compact unit. The ROM and RAM associated with the microprocessor 60 may be formed on the same chip with the microprocessor 60 or may be formed on separate chips and externally connected thereto. The microprocessor 60 communicates with the ROM and RAM at a data rate of approximately 32 megabits per second but this rate of communication does not cause an excessive power consumption or unduly increase the size of the system. Further, as mentioned above, if this high external data rate creates a problem the memories can be formed on the chip with the microprocessor 60.

Figure 7:
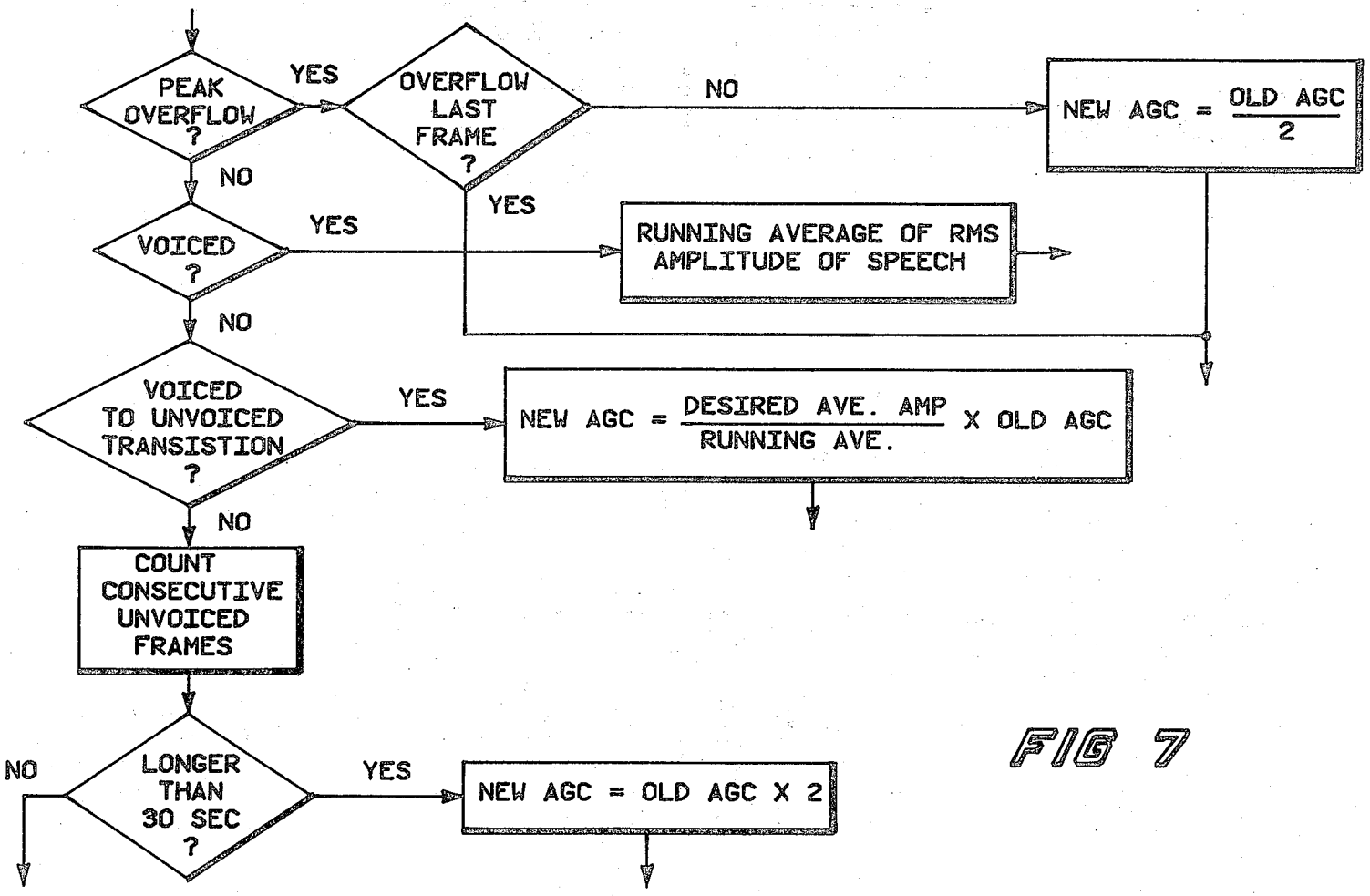
FIG. 7 illustrates an AGC flowchart.

Referring to FIG. 7, a flowchart for an improved automatic gain control circuit (AGC) is illustrated. Generally, the purpose of the AGC is to cause the system to use the full dynamic range of the analog-to-digital converter 43. When the full dynamic range is not used the output of converter 43 can appear to contain noise. Noise has a very adverse effect on LPC voice processing. Also, the pitch extraction algorithm requires a high amplitude. Thus, the AGC improves the overall operation of the disclosed voice processing system.

Figure 8:
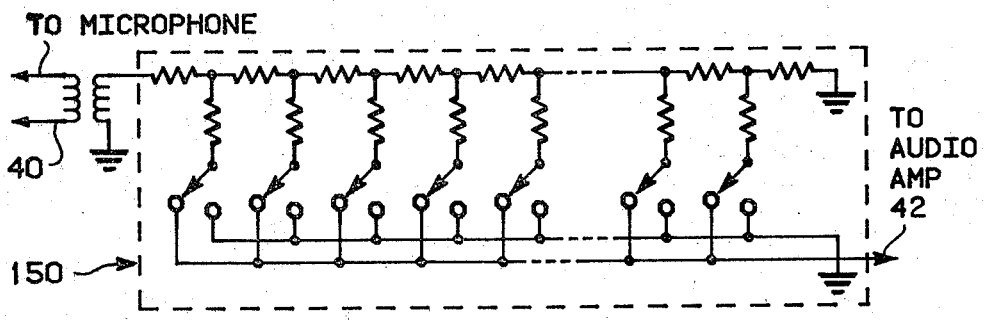
FIG. 8 illustrates apparatus controlled by embodying the new AGC.

The various decisions and controls specified in FIG. 7 are programmed into the microprocessor 60, as will be readily understood by those skilled in the art. The actual changes in amplitude of the input signal are accomplished by the structure illustrated in FIG. 8. Basically the circuit is an R/2R current ladder digital-to-analog converter generally designated 150. The D/A converter 150 has an input connected to the microphone 40 and an output connected to the audio amplifier 42 (see FIG. 2). The ladder network of the D/A converter 150 may have, for example, 12 sections and 12 associated switches. The switches are connected to the microprocessor 60 for operation in accordance with the flowchart of FIG. 7.

In the initial step the A/D converter 43 is monitored to determine whether the peak amplitude of signals applied thereto in each frame causes an overflow. If an overflow is detected in the present frame, the microprocessor 60 determines whether there was an overflow, and subsequent compensation in the previous frame. If no overflow occurred in the previous frame the microprocessor 60 operates switches in the D/A converter 150 so as to reduce the output signal by one-half. If an overflow, and subsequent compensation, occurred in the previous frame, the microprocessor 60 simply ignores the present overflow and goes on to monitor the next frame.

When no overflow is detected in the A/D converter 43 the microprocessor 60 determines whether the signal is voiced or unvoiced, as previously explained. If it is determined that the signal is voiced the microprocessor 60 stores a running amplitude of the r.m.s. amplitude of the speech. When a voiced-to-unvoiced transition is detected the microprocessor 60 divides a predetermined, desired average amplitude of signal by the stored running amplitude and multiplies the resulting ratio by the previous signal (old AGC signal) to produce a new signal (new AGC signal) which is used to control the D/A converter 150. When the running average amplitude is below the desired amplitude the ratio is greater than 1 and the new AGC signal causes the D/A converter to increase the output. Conversely, if the running average amplitude is greater than the desired amplitude the D/A converter 150 is controlled to reduce the output. It will be noted that control of the D/A converter 150 is programmed to occur near transitions of the input signal and during unvoiced periods so that changes in the AGC will be unnoticed.

When the input signal is unvoiced the microprocessor 60 counts the consecutive unvoiced frames. If the input signal is unvoiced for longer than 30 seconds the microprocessor 60 controls switches in the D/A converter 150 so as to double the amplitude of the output signal therefrom. It is of course understood that long periods of unvoiced signal are only background noise, and this may be an indication of system trouble. When the input signal is unvoiced for less than 30 seconds it is generally only a pause in the conversation and the microprocessor 60 resets its internal counter and begins counting unvoiced frames at the next occurrence.

Thus, an improved AGC is disclosed which includes a course adjustment of the input signal at each end of the range and a fine adjustment while the input signal is within the desired range. Further, adjustments to the AGC are generally made during unvoiced portions of the communication so that they are virtually unnoticed in a conversation.

While I have shown and described a specific embodiment of this invention, further modifications and improvements will occur to those skilled in the art. I desire it to be understood, therefore, that this invention is not limited to the particular form shown and I intend in the appended claims to cover all modifications which do not depart from the spirit and scope of this invention.

What is claimed is:

1. A digital voice processing system incorporating a complete vocoder algorithm and including means for converting audio signals to digital electrical signals comprising:

(a) a first integrated circuit semiconductor chip including pitch extraction means connected to receive the digital electrical signals for providing a first plurality of signals representing a plurality of different audio characteristics;

(b) a second integrated circuit semiconductor chip including partial correlation voice analyzer means connected to receive the digital electrical signals for providing a plurality of signals representing a second plurality of different audio characteristics;

(c) a third integrated circuit semiconductor chip including partial correlation audio synthesizer means for receiving a plurality of signals representing different audio characteristics and synthesizing audio signals therefrom;

(d) transmission and receiving means;

(e) a fourth integrated circuit semiconductor chip including a microprocessor coupled to said transmission and reciving means; and (f) means coupling the first and second pluralities of signals from said first and second chips to said fourth chip and coupling a plurality of signals representing different audio characteristics from said fourth chip to said third chip for duplex operation, the complete vocoder algorithm being partitioned among the first, second, third and fourth chips so that only low data rate signals are coupled by said coupling means.

2. A digital voice processing system as claimed in claim 1 wherein the fourth chip includes timing circuits for full duplex operation.

3. A digital voice processing system as claimed in claim 1 wherein the system includes switching means for altering the various means to operate at any one of a plurality of different bit rates.

4. A digital voice processing system as claimed in claim 1 wherein the pitch extraction means includes apparatus for providing average magnitude difference function pitch extraction.

5. A digital voice processing system as claimed in claim 1 having in addition an AGC circuit coupled to the means for converting audio signals to digital electrical signals and controlled by the microprocessor of the fourth chip.

6. A digital voice processing system as claimed in claim 5 wherein the AGC circuit includes a digital-to-analog converter.

7. A digital voice processing system as claimed in claim 6 wherein the digital-to-analog converter includes an R/2R current ladder.

8. A method of manufacturing a digital voice processing system incorporating a complete vocoder algorithm for analyzing and synthesizing the audio to provide duplex operation including the steps of:

(a) providing a plurality of integrated circuit semiconductor chips carrying circuitry for performing the vocoder algorithm; and (b) partitioning the vocoder algorithm among the chips so that all communication therebetween occurs at low data rates.

9. A method of manufacture as claimed in claim 8 wherein the vocoder algorithm is linear predictive coding.

10. A method of manufacture as claimed in claim 9 wherein the plurality of semiconductor chips provided includes a pitch extraction chip, a partial correlation voice analyzer chip, a partial correlation voice synthesizer chip, and a microprocessor chip.

* * * * *